United States Patent [19]

Prunbauer et al.

[11] Patent Number: 4,516,416

[45] Date of Patent: May 14, 1985

[54] LOCKING DEVICE AND KEY

[75] Inventors: Kurt Prunbauer, Herzogenburg; Erich Csapo, Vienna, both of Austria

[73] Assignee: Evva-Werk Spezialerzeugung von Zylinder- und Sicherheitsschlössern Gesellschaft m.b.H. & Co. Kommanditgesellschaft, Vienna, Austria

[21] Appl. No.: 572,952

[22] Filed: Jan. 20, 1984

Related U.S. Application Data

[63] Continuation of Ser. No. 232,244, Feb., 1981, abandoned.

[30] Foreign Application Priority Data

| | | | |
|---|---|---|---|
| Feb. 8, 1980 | [AT] | Austria | 701/80 |
| Feb. 14, 1980 | [AT] | Austria | 811/80 |
| Mar. 3, 1980 | [AT] | Austria | 1167/80 |

[51] Int. Cl.[3] ..... E05B 27/06; E05B 47/00

[52] U.S. Cl. ..... 70/276; 70/358; 70/386; 70/409; 70/421

[58] Field of Search ..... 70/386, 276, 358, 363, 70/405, 376, 419, 406, 421, 409, 352, 364 R, 364 A

[56] References Cited

U.S. PATENT DOCUMENTS

| | | | |
|---|---|---|---|
| 2,121,301 | 6/1938 | Ractliffe | 70/276 |
| 2,177,996 | 10/1939 | Raymond | 70/276 |
| 2,565,531 | 8/1951 | Spiegler | 70/386 |
| 3,286,494 | 11/1966 | Sussina | 70/386 |
| 3,516,271 | 6/1970 | Nelson et al. | 70/276 |
| 3,650,132 | 3/1972 | Berube | 70/364 A |
| 3,802,234 | 4/1974 | Gerlach | 70/421 |
| 4,220,021 | 9/1980 | Burger et al. | 70/276 |
| 4,320,638 | 3/1982 | Dunphy et al. | 70/409 X |
| 4,331,013 | 5/1982 | Jaulmes | 70/276 X |

FOREIGN PATENT DOCUMENTS

| | | | |
|---|---|---|---|
| 2,630,804 | 1/1978 | Fed. Rep. of Germany | 70/355 |
| 910262 | 4/1954 | German Democratic Rep. R | 70/386 |
| 53649 | 1/1923 | Sweden | 70/358 |

*Primary Examiner*—Robert L. Wolfe
*Assistant Examiner*—Lloyd A. Gall
*Attorney, Agent, or Firm*—Michael J. Striker

[57] ABSTRACT

A closure device has a cylinder core turnable in a housing and a key insertable into a key channel in the core. A ball provided in a circumferential groove in the inner wall of the housing cooperates with an edge portion of the key. A pin is arranged in the same plane and 180° away from the ball.

19 Claims, 17 Drawing Figures

135
126
132
133
131
129
123
122
124
104
136

LOCKING DEVICE AND KEY

This application is a continuation of application Ser. No. 232,244, filed Feb. 6, 1981, now abandoned.

BACKGROUND OF THE INVENTION

The invention relates to a closing device for a cylinder core turnable in a housing and a key insertable into a key channel. Such closing devices have been known for a long time as cylinder locks. The known constructions of such cylinder locks have, however, the disadvantage that with respect to locking safety and possibility of variation they no longer entirely meet current requirements. This is true particularly with respect to the construction of large locking systems in the conception of which many variation possibilities which theoretically exist are lost in actual practice. This is true under certain circumstances also of magnetic locks which operate on the basis of magnetic rotor holders. In the previous magnetic locks it, for e.g. space reasons, is not possible to increase the number of magnetic pills from three to four without substantially changing the dimensions which are customary for cylinder locks and their keys.

SUMMARY OF THE INVENTION

The disadvantages of the heretofore known constructions are eliminated according to the invention in that the key is provided on two surfaces with ribs and/or recesses extending transversely to its direction of insertion, which ribs or recesses control blocking elements that are shiftable transverse to the direction of insertion of the key and which in the blocking position extend into a recess in the housing and in the released position are arranged within the separating face between the cylinder core and housing. According to a further feature the surfaces are the longitudinal edges of the keys, and the blocking elements are balls which are guided in bores in the cylinder core. The invention is further characterized in that a recess on the key corresponds to the arrangement of a ball in the cylinder core and that in the event of the arrangement of a rib at this location the ball is omitted.

In a preferred manner at least one of the ribs has associated with it a ball which is guided in a circumferential groove on the inner housing surface and thus permits a turning of the cylinder core, and in that in the same plane at the opposite longitudinal edge of the key, a key retaining pin is arranged which cooperates with a recess and is of several parts, the partition of which is located in the separating plane between cylinder core and housing at appropriate depth of the recess and that the housing pin slides under the pressure of a spring after turning of the key through 180° over the ball held by the rib in the groove, respectively, that in the event of erroneous arrangement of a recess at this location the key snaps into the bore of the ball whereby the cylinder core is blocked.

Further preferred embodiments of the inventive closing device are characterized in the other subclaims.

BRIEF DESCRIPTION OF THE DRAWING

Hereafter the invention will be described by way of example in more detail with reference to the drawings.

DESCRIPTION OF THE PREFERRED EMBODIMENTS

The embodiments illustrated in the various Figures are based upon magnetic cylinder locks as they have already been previously suggested and described, for example, in the German published application OS 2,905,941. The involved structural elements and their operational effect will therefore be described only briefly.

Figure 5:
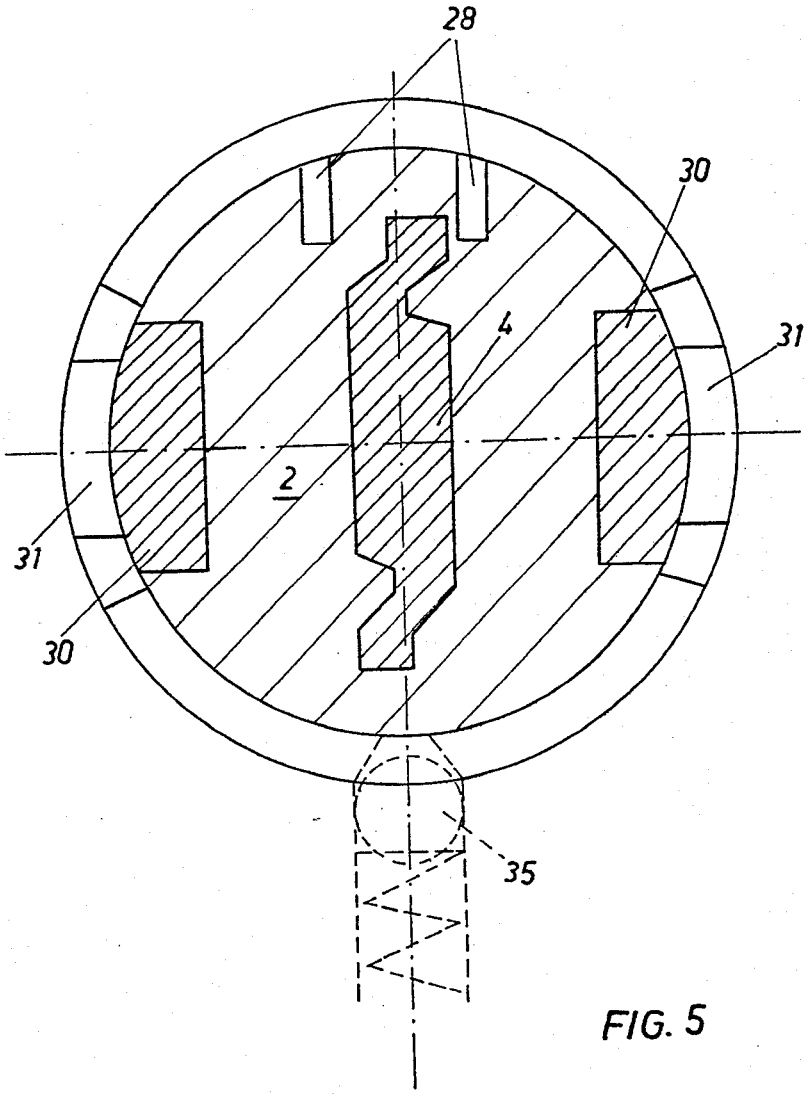
FIG. 5 is a section according to line V—V in FIG. 1.

A cylinder core 2 is turnably mounted in the cylinder housing 1 and has a key channel 3 into which a key 4 is fully inserted. The key channel is centrally arranged in the cylinder core, i.e., the upper longitudinal edge 5 of the key (in conventional keys, the back of the key) is also surrounded by the material of the cylinder core and is not flush with the circumferential surface of the cylinder core (see FIG. 5). The key 4 has four throughgoing magnetic pills 25 which may be differently magnetized at opposite sides. Parallel to the magnetic pills of the key, magnetic rotors 26 are arranged in the cylinder core 2 which, depending upon the magnetization of the key pill, assume a certain angular position. In known manner, assuming a proper position of all magnetic rotors on one side of the core, an axial shifting of an axial blocking member 30 is permitted. At the side facing towards the housing the axial blocking member 30 carries blocking pieces 31 which extend into an axial groove 32 of the cylinder housing 1. The farthest inner blocking piece 31 is located in a recess 33 of a ring 34 which outwardly encircles the cylinder core 2 and is freely turnable relative to the same. The position of the ring relative to the housing 1 is removably fixed by means of a snap-type ball 35. The parts 30, 31 and 34 are shown in phantom lines in FIG. 1 in the center section.

When the cylinder core 2 is turned with the key 4, the inner blocking piece 31 rides up on an inclined flank of the recess 33 of the ring 34 and the axial blocking member is shifted to the left. This causes all blocking pieces 31 to be moved into such an axial position that they register with annular grooves 50 at the inner surface of the housing and will be guided in these grooves on turning of the cylinder core.

If a key is used having the wrong magnetic coding, so that the axial blocking member cannot be shifted towards the left, the innermost blocking piece 31 remains in engagement with the recess 33 of the ring 34 and if an attempt is made to force the lock, the holding force of the snap-type ball 35 is overcome. The cylinder core can then be turned through a short distance until the blocking pieces 31 engage against the limiting faces of the axial groove 32. A further turning of the cylinder core and thus a blocking of the closing device is thereafter impossible.

Arranged in the cylinder core 2, along the longitudinal edges of the key channel, are bores 11 which extend from the key channel to the plane of separation between the cylinder housing and the cylinder core. Balls 10, 14 and 39 are shiftably accommodated in the bores 11. As particularly clearly shown in FIG. 3, the bores 11 are blind bores which permit an intrusion of the balls 10 into the key channel only to such an extent as is necessary for the movement of the balls to release position. The longitudinal edges 5, 6 of the key 4 are provided with ribs 8 and recesses 9 which extend transversely to the direction of insertion 7. Each of the balls 10 has a recess 9 associated with it. Because of these recesses 9 the balls 10 can assume a position—on turning of the key and of the cylinder core—in which they are located entirely within the cylinder core 2 (compare FIG. 3). The possibility for the balls to move transversely to the direction of insertion 7 of the key is allowed in that the cylinder housing has a recess (groove) 12 in the axial direction. If a wrong key is provided at a location at which it engages a ball 10 with a rib 8 instead of a recess 9, then the corresponding ball 10 abuts against the surface 37 and a further turning of the cylinder core is blocked. If at such a position the correct key is intended to have a rib, then at this location no ball may be accommodated in the associated bore 11.

To further increase safety of the device against tampering, a ball 14 is arranged in a bore 11 and permits a turning of the cylinder core only if at the corresponding position the key has a rib 8 and not a recess 9 as in the case of the balls 10. The effect of the ball 14 results from a cooperation with the key holding pin 17 which is located in the same rotary plane and the circumferential annular groove 15 in the housing 1. The key holding pin 17 is composed of a housing pin 18 and a core pin which is formed by two balls 21. The key holding pin 17 is maintained in known manner in separation by the depth of the recess 16 of the key, so that the core pin can be shifted relative to the housing pin. The funnel-shaped configuration 38 of the housing pin 18 provides for a certain arresting effect due to which the cylinder core receives a defined center position relative to the housing. When the cylinder core is turned, the lower of the two balls 21 travels in the annular groove 15 as well as the ball 14 which is held in its position by the rib 8. After a turning of the key 4 through 180° the ball 14 reaches the housing pin 18 and slides over the same, the arresting effect by the funnel-shaped configuration 38 being negligible in this case. The cylinder core can thus continue to be turned and the blocking movement can be completed. If, however, a recess 9 is located in place of the rib 8, as shown in broken lines, then the ball 14 will be pushed inwardly by the housing pin 18 under the pressure of spring 19 after a turn through 180° has been completed, and the funnel-shaped end of the housing pin 18 enters into the bore 11 of the ball 14 and thus prevents a further turning of the cylinder core.

The ball 39 which is farthest inwardly in the core also cooperates with a rib 8 constituted by a longitudinal edge portion of the key and a housing pin 40 which is subjected to the pressure of the spring 41. If the wrong key is inserted which is formed with a recess in place of the rib 8, then the ball 39 is pressed by the spring 41 and the housing pin 40 enters into the recess, and the housing pin 40 engages into the bore 11 and blocks the cylinder core relative to the housing. When the cylinder core is turned with the correct key, the opposite location of the cylinder wall (having the form of a tongue 20) moves to the housing pin 40 as indicated by arrow 51 in FIG. 4. The tongue 20 is so configured that the housing pin 40 slides on the surface of the cylinder core and does not enter into the slot 28 for the coupling element 27, because otherwise the housing pin would be caught in the slot 28 and prevent continued turning of the cylinder core.

Figure 1:
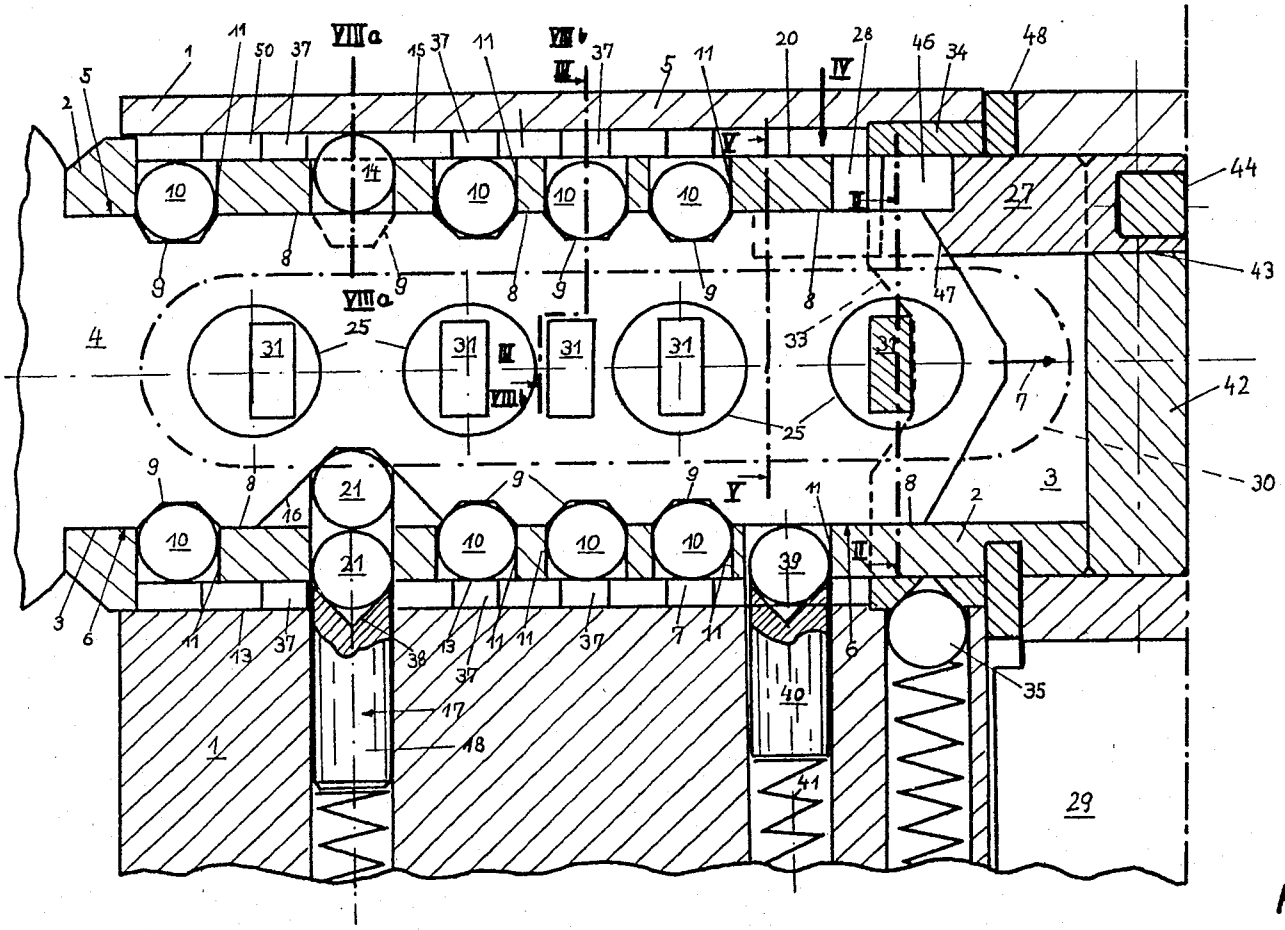
FIG. 1 is an axial longitudinal section through the left half of a double cylinder lock according to the invention, with some parts located above the plane of the section being illustrated for better understanding.
Figure 2:
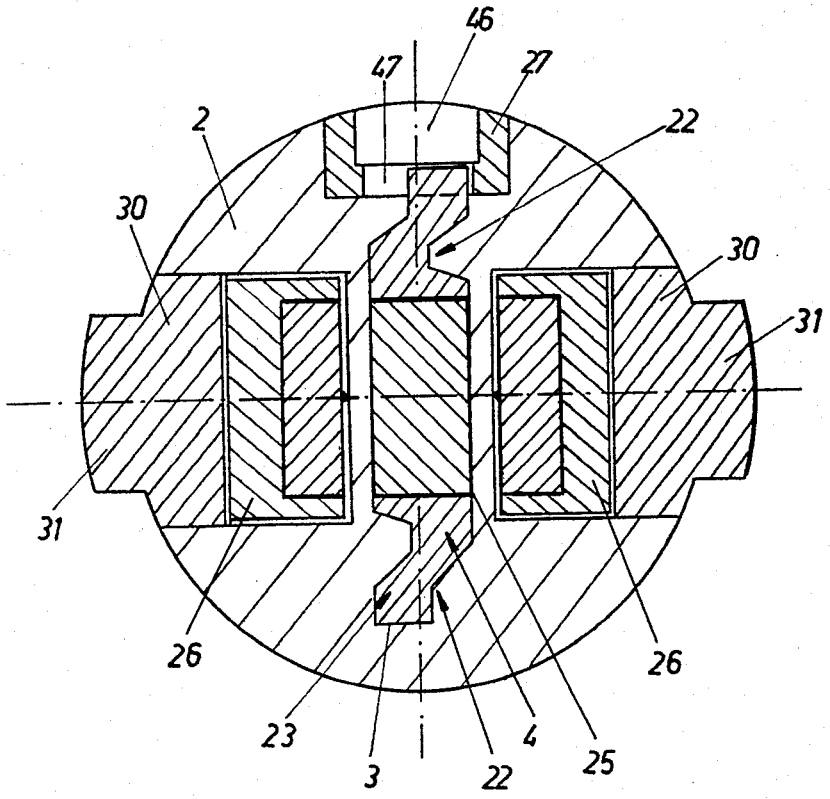
FIG. 2 is a section through the cylinder core on line II—II of FIG. 1.
Figure 4:
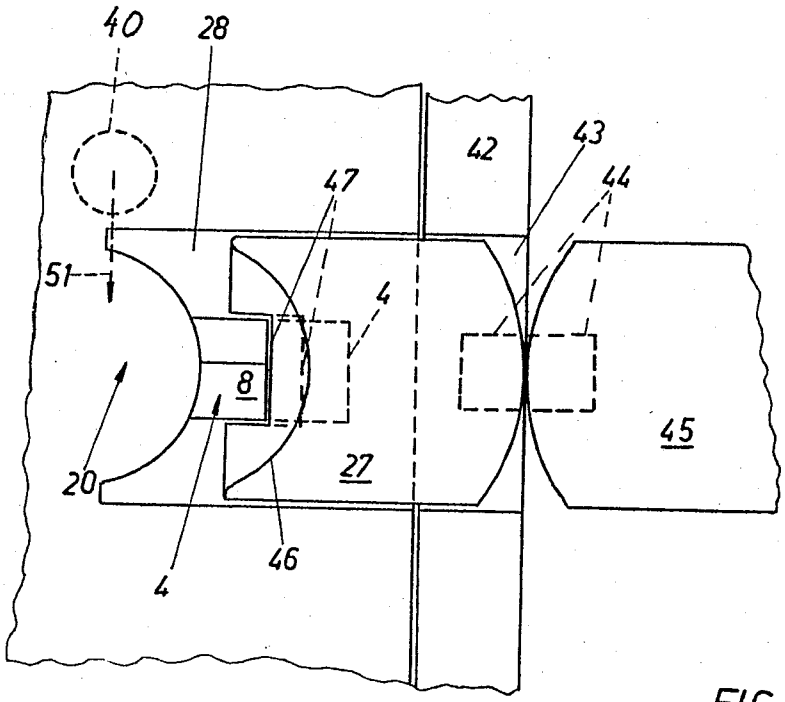
FIG. 4 is a plan view of the cylinder core according to arrow IV in FIG. 1, with the cylinder housing not having been illustrated.

The shape of the coupling element is clearly shown in FIGS. 1, 2 and 4. The coupling element 27 is shiftable axially in the slot 28 of the core 2 and can snap into a coupling plate 42 which is connected with a blocking nose ring 29. The plate 42 has a groove 43 for snap engaging the end of coupling element 27. The end of the coupling element which enters into the groove 43 carries a permanent magnet 44 which releasably holds (FIG. 4) an analogously constructed second coupling element 45 of the second right-hand cylinder core of the double cylinder lock. At its other end the coupling element 27 is provided with a recess 46 for the tongue 20 and has an abutment 47 via which the coupling element 27 is shifted in the direction towards the coupling plate by the tip of the key, in particular the foremost rib 8 thereof.

In the region of the just described coupling the cylinder core is held in position by means of a circlip 48 which must, of course, be so shaped that it does not prevent the axial movements of the coupling elements 27 and axial blocking members 30 that are arranged on the surface of the cylinder core.

The above described coupling construction is particularly advantageous in the context of the lock construction disclosed in FIG. 1 because this coupling makes it possible to arrange a fourth magnetic rotor on each side of the key 4 in the vicinity of the coupling. In previously known coupling constructions this space was needed for the arrangement of another coupling.

Figure 7:
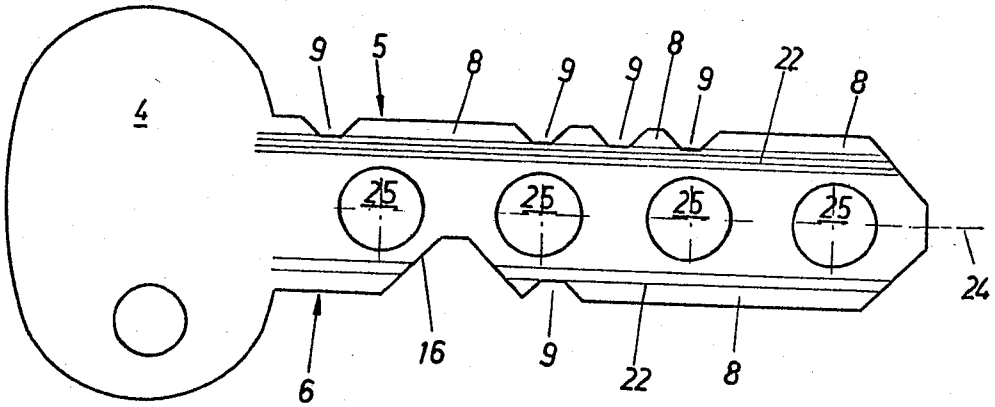
FIG. 7 is a side view of an inventive key.

FIG. 7 is a side view of a key as shown also in FIG. 1. The drawing shows that four magnetic pills 25 are arranged along the centerline 24 of the key 4 and that at both sides, grooves 22 and ribs 23 are arranged in the longitudinal direction of the key. The ribs 8 and recesses 9 at the longitudinal edges 5, 6 of the key are arranged transversely to the direction of insertion of the key. Reference numeral 16 identifies the recess for the key holding pin 17. In the inventive key the longitudinal ribs and grooves which are missing due to the magnetic pills 25, are in effect arranged along the flat sides of the keys, at the narrow longitudinal edges 5, 6 and extend transversely to the direction of insertion of the key. Such ribs and recesses extending transversely to the direction of insertion of the key could also be arranged at the flat sides of the key, e.g. between the magnetic pills. However, the construction of such a key and the lock construction needed for it would be more complicated and more susceptible to malfunction.

Figure 6:
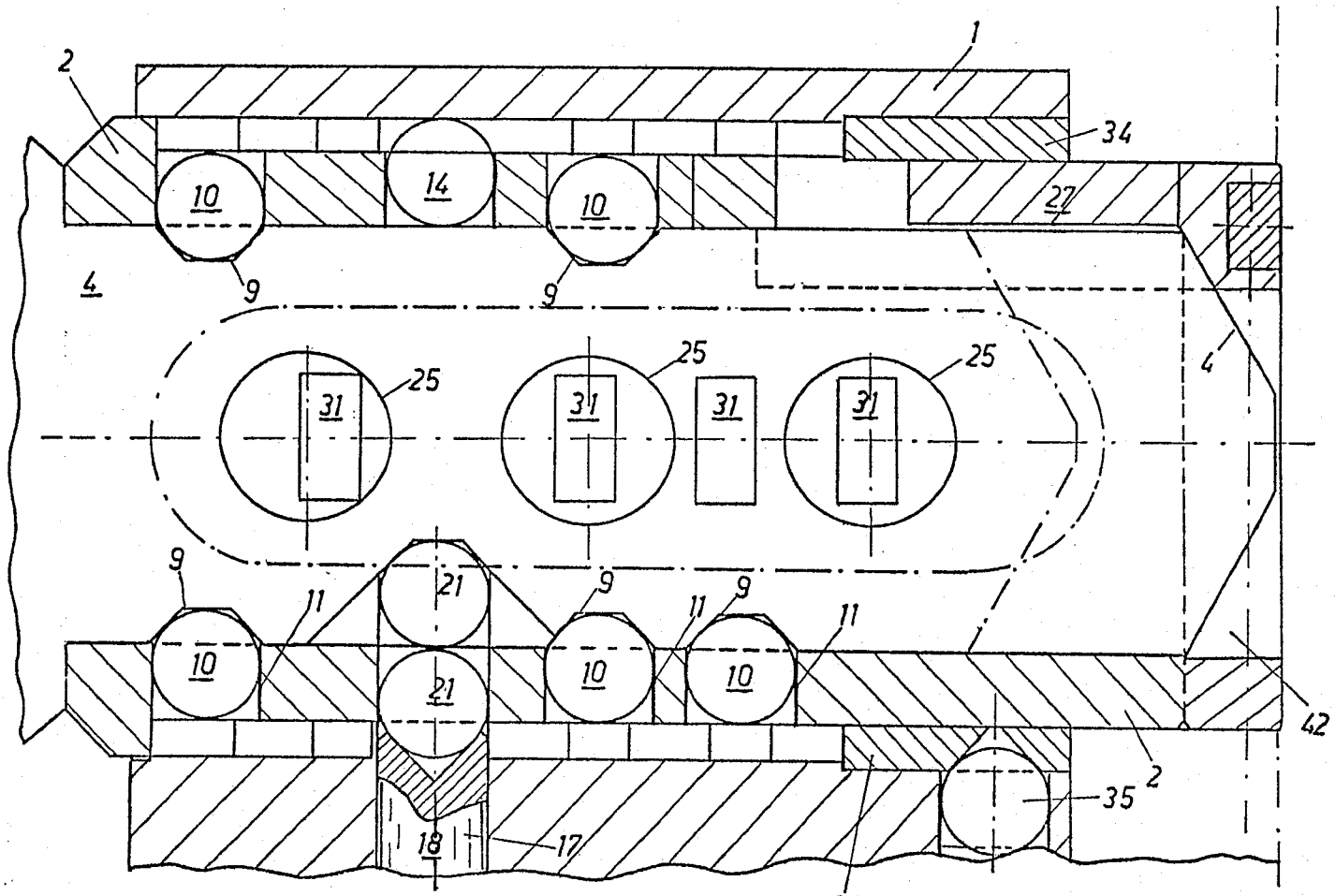
FIG. 6 illustrates a second embodiment of the construction according to the invention.

FIG. 6 shows a further embodiment of the invention in the form of a so-called short cylinder which is used e.g. in doors of small thickness. Here, there is room on each side of the key for only three magnetic rotors as well as a smaller number of bores 11 and associated balls 10. However, it is evident that the remaining blocking elements are arranged analogously to the construction shown in FIG. 1. The key according to FIG. 1 will unlock the lock according to FIG. 6, but the key of FIG. 6 will not unlock the lock disclosed in FIG. 1. The possibility of being able to use a long key also in a short cylinder is of particular advantage for the manufacture of lock systems. The inner variation elements of the key are without importance and could also be eliminated. A thus shortened key is shown in broken lines in FIG. 6. Because of the length of the key 4 the same extends into the coupling plate 42 so that the same must have a slot to receive the tip of the key. With respect to the possibilities of variations in the inventive lock, it should be noted that each ball and its associated groove or rib at the longitudinal edge of the key furnishes two additional variations, similar to the known longitudinal profiles. The fourth magnetic pill in the tip of the key furnishes, given eight possible magnetic vector positions, $8^2=64$ additional variations per side of the key.

In some instances it will not be necessary to provide the key with the maximum number of (here four) magnetic pills and the lock with the associated eight magnetic rotors. To reduce costs and if no very large number of variation possibilities is required, it may also be sufficient to provide only three magnetic pills and six magnetic rotors despite a sufficient length of the key and of the cylinder core. Even this furnishes more possibilities for variations than the conventional magnetic locks with three magnetic pills, because the arrangement of the three magnetic pills and the magnetic rotors at the four or eight locations, can be selectively chosen. To make copying of a key more difficult the remaining space in the key may carry an uncoded magnetic pill, or a magnetic pill which is coded in any desired manner (simulated coding). In this event the lock would have to omit the magnetic rotors at this location. This is true not only for lock construction of the above described type, but for all magnetic locks with magnetic pills in the key and magnetic rotors in the lock.

Figure 3:
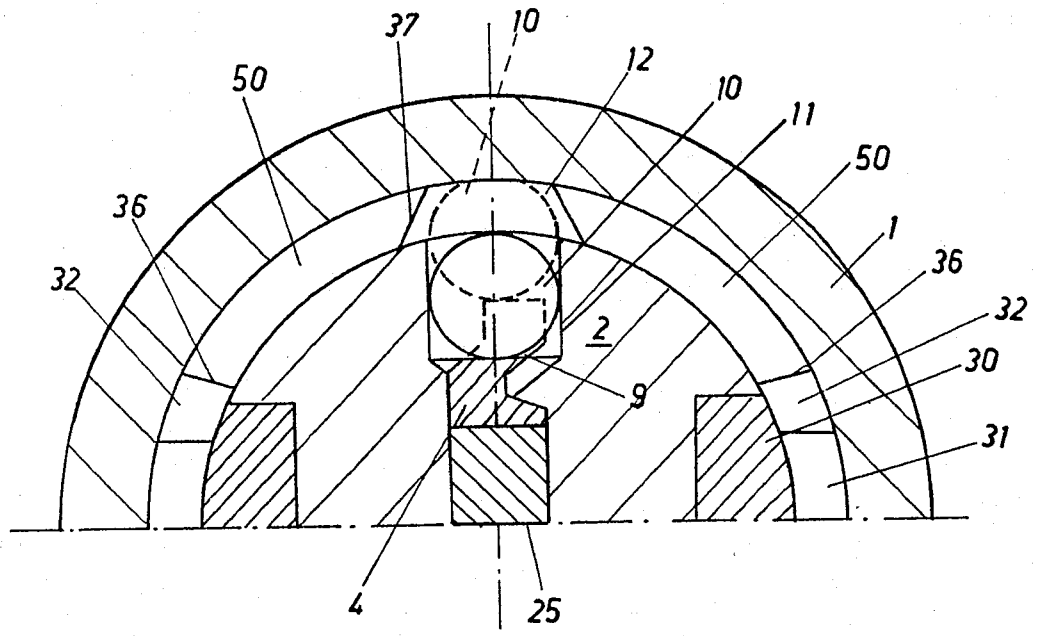
FIG. 3 shows a fragmentary section along line III—III in FIG. 1.
Figure 8:
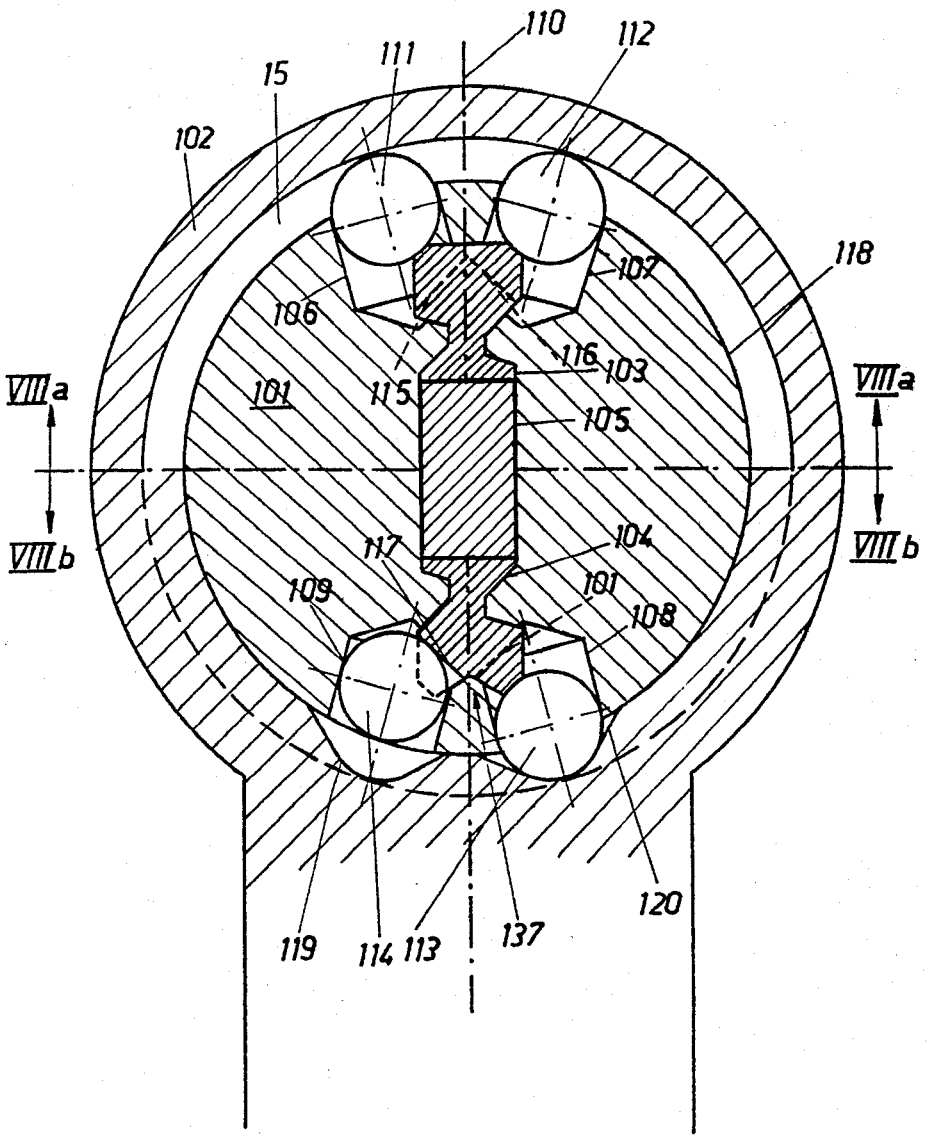
FIGS. 8–17 illustrate further exemplary embodiments.

An exemplary embodiment is illustrated in several variations in FIGS. 8–14. The above described inventive concept is further developed in this embodiment. FIG. 8 is a cross section extending radially through the cylinder and corresponding approximately to the one shown in FIG. 3. In order to simplify the illustration, certain elements, e.g. the axially shiftable blocking members 30 and the magnetic rotors, were omitted which are shown in FIGS. 2 and 3. The upper half of the section corresponds approximately to a section VIII*a*–VIII*a* in FIG. 1 and the lower half of the section corresponds approximately to a section VIII*b*–VIII*b* in FIG. 1.

In this embodiment the core has reference numeral 101 and the housing is identified with reference numeral 102. A key 104 with a magnetic pill 105 is inserted into the centrally arranged key channel 103. The core 101 has blind bores 106–109 which, unlike the above-described construction, are not located in the longitudinal center plane 110 of the key but instead extend skew to the longitudinal edges of the key channel and of the key. Balls 111–114 are arranged in the bores 106–109. These balls correspond to the balls 10, 14 and 39 of the embodiment in FIG. 1. Due to the inclined arrangement of two adjacent bores 106, 107 and 108, 109, it is possible to accommodate along the length of the key channel twice the number of balls as compared to the construction in FIG. 1, and, of course, this correspondingly increases the number of possible variations.

The balls 111, 112 correspond in their effect to the ball 14 of FIG. 1. In other words, these balls must be held within the annular groove 15 in the housing 102 by the arrangement of an appropriate rib on the key 104. If this is not the case and the key instead has at these locations the broken-line cut-outs 115 or 116 which are shown in the drawing, then one of the balls 111 or 112 would be pushed into the bore after a rotation of the cylinder core through 180° by the housing pin 18 which is shown in FIG. 1, and the housing pin 18 would then also enter into the bore 107 or 106 and block the cylinder core 101 against further turning relative to the housing 102. The balls 111, 112 might thus also be considered as control balls.

Balls 113 and 114 correspond to the balls 10 in FIG. 1 and the cut-out 117 corresponds to the recess 9. These balls, which might be considered as balls serving to permit lock variations, must disappear within the outer circumferential surface 118 of the cylinder core during rotation, in contrast to the balls 111, 112. The possibility of movement of the balls 113, 114 in the rest position of the cylinder core is assured by the presence of the axially extending recesses 119 and 120. The ball which is shown at the lower left side in FIG. 8 is located opposite to the cut-out 117 of the key so that it can recede into the bore 109 when the cylinder core is turned and thus assume the illustrated position.

The ball 113 which is shown at the right side of FIG. 8 is not located opposite any cut-out of the key and thus cannot enter into the bore 108 when the cylinder core is turned. Therefore, it blocks the lock. The key which is shown in FIG. 8 in cross section will thus seem to be wrongly coded (for example an unauthorized copy) and due to the absence of the cut-out 121 shown in broken lines in FIG. 8, such a key will block the lock in this embodiment.

Figure 9:
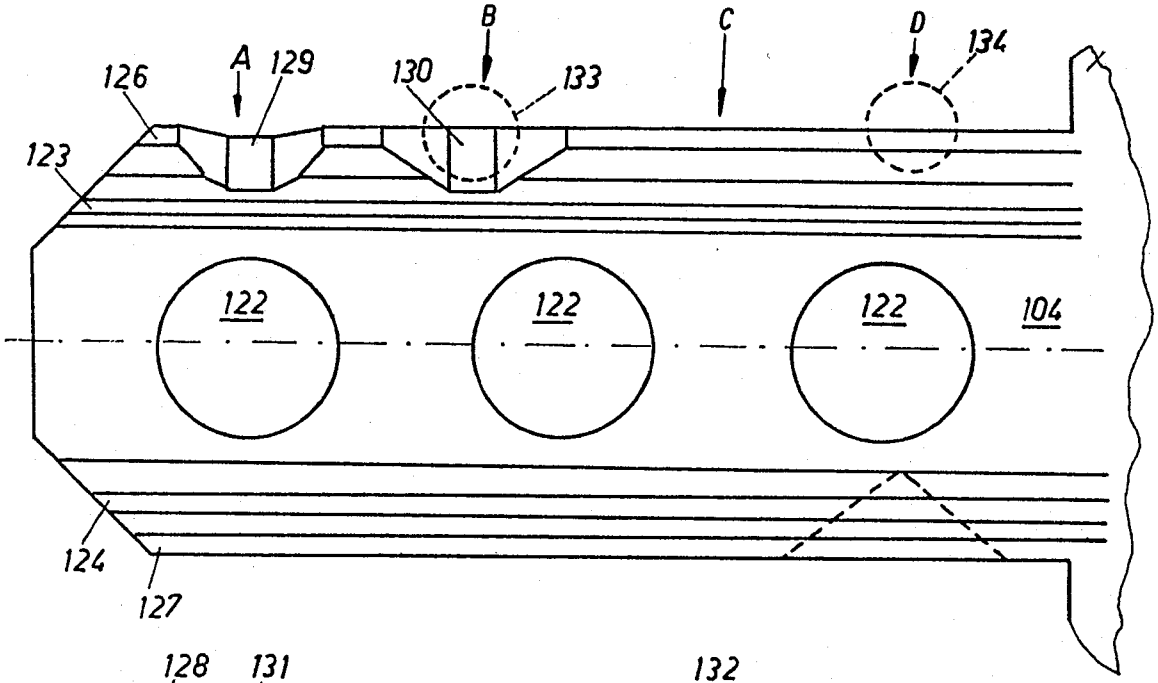
Figure 10:
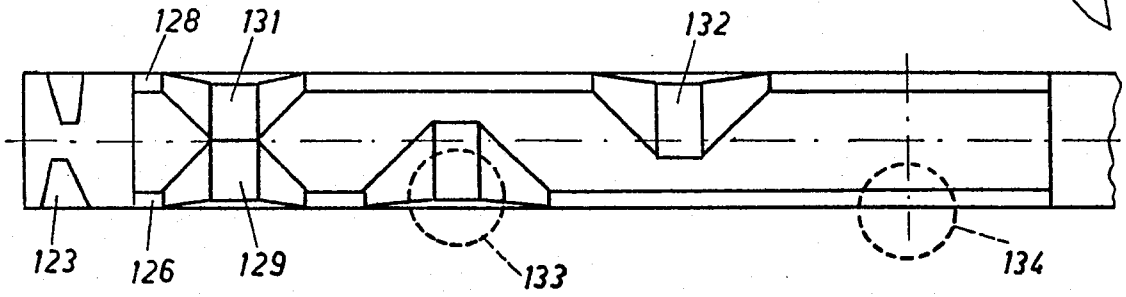

FIGS. 9 and 10 show the key 104 which is used in conjunction with the lock of FIG. 8. In this embodiment the key carries magnetic pills 122 and on the flat side shown in FIG. 9 it is provided with the longitudinal grooves 123, 124. The key web 125 is shown only in part and broken away.

The longitudinal edges of the key 104 are interrupted by bevels 126, 127 and 128. The fourth longitudinal edge which is not shown in FIGS. 9 and 10 is also beveled. These bevels 126–128 serve as the rolling surface for the balls 111–114 when the key is inserted into the key channel, so that a wear of these edges with respect to cooperating sharp edges is substantially reduced.

Along the bevel 126 the key is provided at the locations A and B with recesses 129, 130. At the locations C and D, however, no such recesses are provided. At the other longitudinal edge of the key, i.e. the bevel 128, the locations A and C have recesses 131 and 132. At the bevel 127 no recesses have been illustrated to simplify the drawing. A ball is shown in broken lines and identified with reference numeral 133 which cooperates with the recess 130. If the key is a properly coded key, then the ball 133 must correspond in its function to the ball 114 in FIG. 8. Another ball 134 is shown in broken lines at the location D and is located opposite the bevel 126. Again, if the key is a properly coded key then the ball 134 must correspond in its function to one of the control balls 111 or 112 in FIG. 8. The recesses in the bevels of the key are so deep that they extend into the longitudinal groove 123. This is advantageous because it avoids the development of sharp edges along the flat side of the key.

Figures 11, 12, 13, 14:
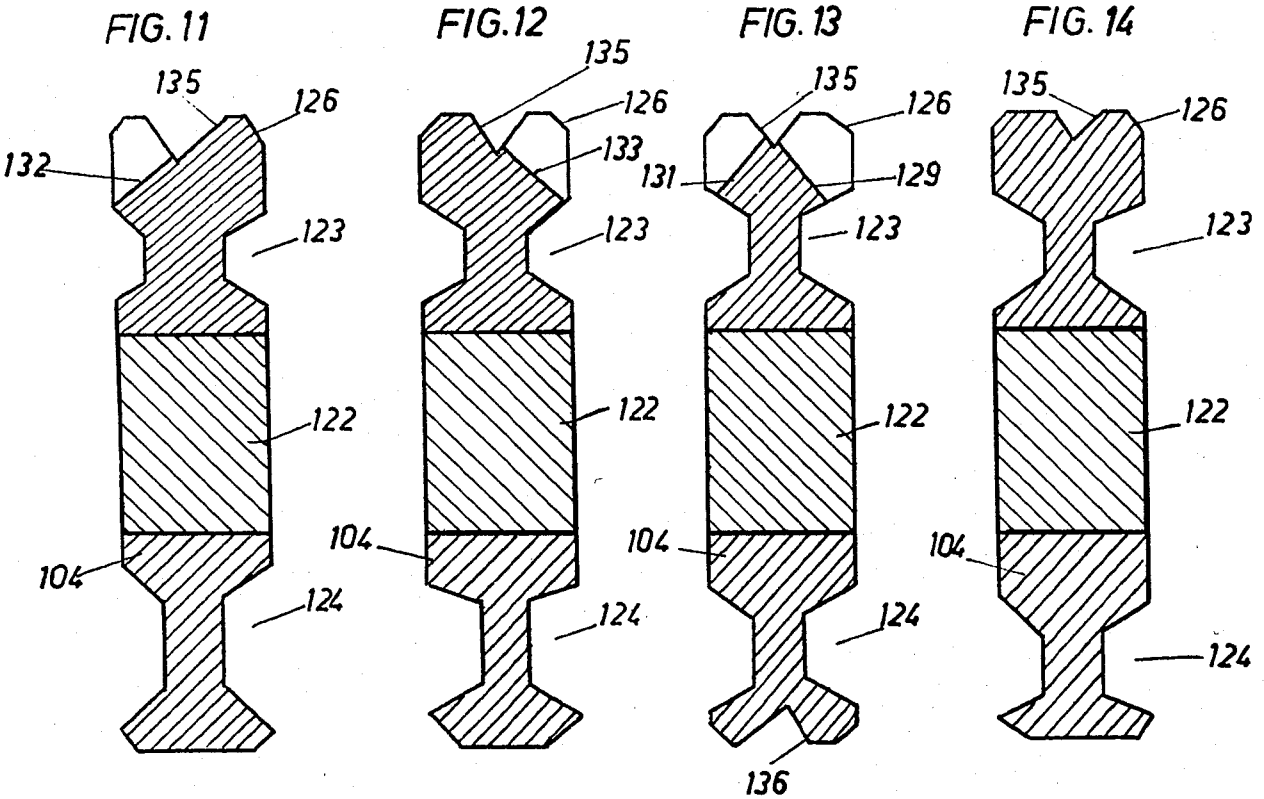

FIGS. 11–14 illustrate various key cross sections which essentially illustrate all possible variations at the locations A, B, C and D. FIG. 11 corresponds to the location C in FIGS. 9 and 10; FIG. 12 corresponds to the location B; FIG. 13 corresponds to the location A; and FIG. 14 corresponds to the location D. These same variations are, of course, also possible at the lower edge of the key.

A further possibility for variations exists in FIGS. 11–14 at the upper edge of the key, in that the key is also provided along its narrow side with a groove 135 or with a groove 136 which extends along the lower narrower side. The grooves 135, 136 must have projections 137 associated with them in the core, but since the key channel is centrally arranged in the cylinder core this is not particularly difficult.

The illustrated key and lock system can also be embodied without the use of magnetic pills and the associated magnetic rotors. In this case the annular grooves 15 and 50 are, of course, not needed in the housing. However, if control balls according to the balls 111 and 112 are provided, the inner circumferential wall of the housing must be formed with the annular grooves 15 and 50. Otherwise the material of the housing can remain untouched so that the diameter for the bore to accommodate the core can correspond to the diameter of the core itself.

In the embodiment according to FIGS. 8–14 a further possibility for variation is possible, assuming the arrangement of magnetic pills, that at e.g. four possible locations (i.e., eight codable surfaces) only three of these locations are provided with coded pills.

Thus, the key according to FIGS. 8–14 offers the following possibilites for variation:

(a) longitudinal grooves and/or ribs (123, 124)

(b) the arrangement of longitudinal grooves or ribs at the back of the key and/or at the base of the key (135, 136, 137)

(c) the arranging or not arranging of recesses at the possible locations of the keys, with a variation being possible both at the individual locations A, B, C or D by different individual or simultaneous arrangement of the recesses at the four longitudinal edges of the key, as well as by the variation of these recesses with the different possible locations A, B, C and D along the key.

(d) Finally, there is additionally the possibility of variation of the magnetic pills used on the key.

Figure 15:
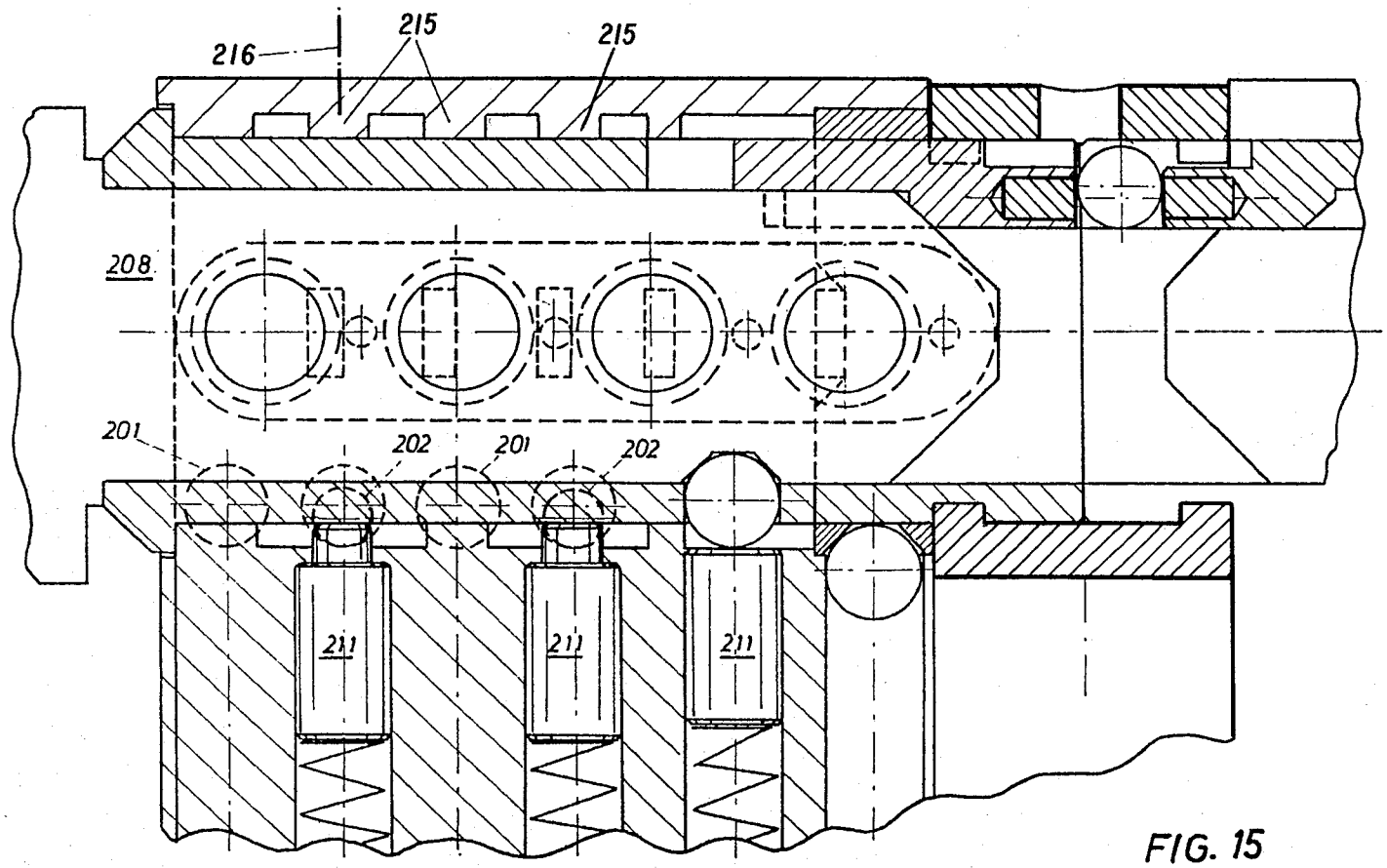
Figure 16:
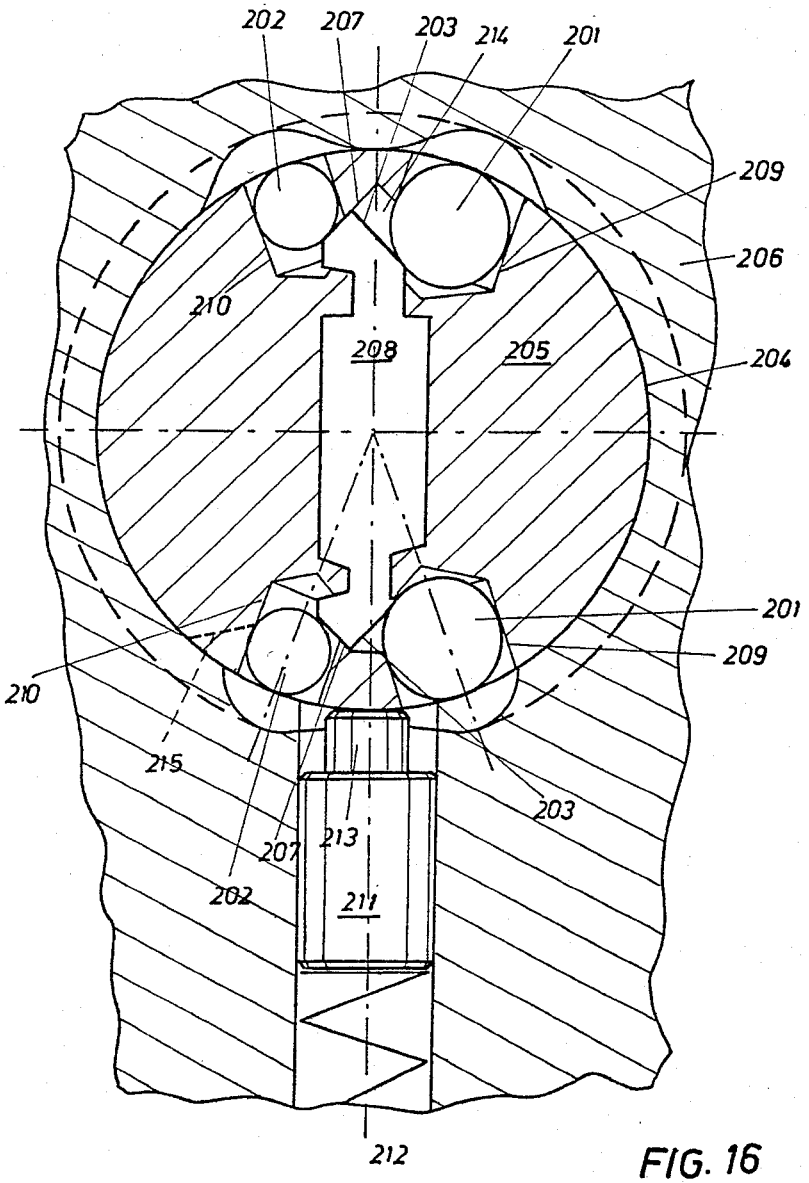
Figure 17:
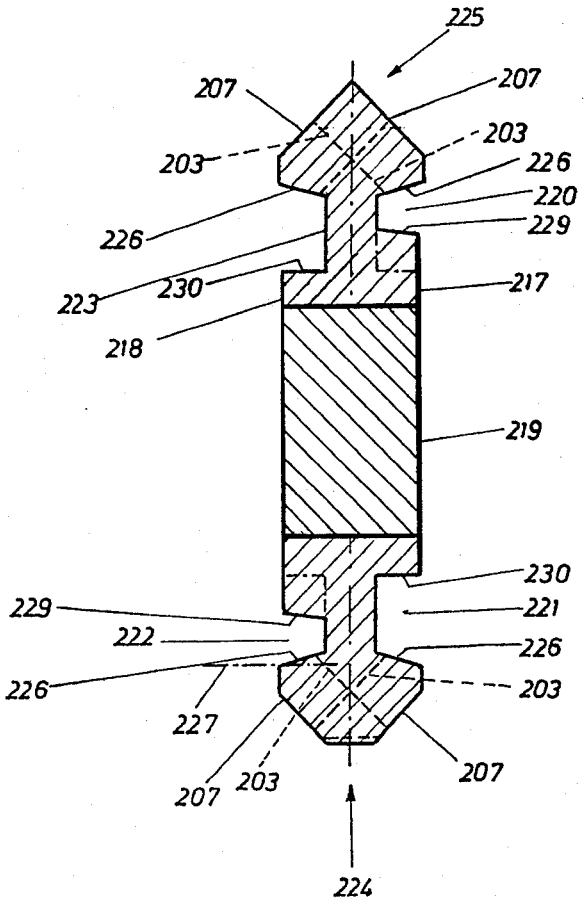

From FIGS. 15–17 it will be seen that these illustrate a lock and an associated key which may have certain advantages as compared with the construction in FIGS. 8–14. In FIGS. 8–14, notwithstanding all other advantages which this embodiment offers, the possibility of selective arrangement of the variation balls which cooperate with the corresponding recesses of the key and the control balls which cooperate with the ribs and control pins, is in practice limited. Thus, the control balls can only be arranged where the housing is provided with an annular groove at the plane of separation between the core and housing. The position of the annular grooves, however, is predetermined by the overall lock construction, particularly by the location of the blocking elements. Therefore, in the construction of the embodiment in FIGS. 8–14 there is no unlimited possibility of choosing the position of the control balls and variation balls.

This problem is overcome in the embodiment according to FIGS. 15–17. In these Figures the parts necessary for an explanation are illustrated only schematically in order to avoid cluttering the drawing. The non-illustrated or non described parts, particularly with respect to a magnetic lock construction, if any, may be the same as in FIGS. 1–7.

In FIGS. 15–17 the diameter of the variation balls 201 is approximately the same as or smaller than the spacing between the bottom 203 of the recesses and the plane of separation 204 between core 205 and housing 206. The diameter of the control balls 202 is approximately the same as or smaller than the spacing between the bevel 207 of the key 208 and the aforementioned plane of separation. Thus, the control balls and variations balls 201, 202 have different diameters. The control and variation balls are preferably guided in bores 209, 210 which each correspond approximately to the diameters of the associated balls. When lock systems and the arrangement of the variation and control balls are conceived, the arrangement of the appropriate bores must therefore be taken into account during the manufacture of the core. Control pins 211 which cooperate with the control balls 202 are subject to spring pressure from springs 212 and are provided at their head ends 213 with a region of reduced diameter, this diameter corresponding to the diameter of the bore 210 for the control ball or balls 202, so that the head end of the control pin can enter into the bore 210 and block turning of the cylinder core if the key is not inserted or if the wrong key is used which at this location has a recess 214. The control and variation balls and the control pins or third housing pins are always arranged in the region of the annular web 215 (compare FIG. 15).

A particular advantage of this embodiment resides in the fact that in the plane (e.g. see line 216) in which a control pin and up to four balls can be located, different balls (i.e., control balls and variation balls jointly) can be provided. In accordance with the previously described embodiments this was not possible because only either control balls or variation balls could be arranged in a radial plane.

FIG. 17 shows the cross section through a key in a particularly preferred embodiment. Both flat sides 217, 218 of the key are provided above and below the magnetic pills 219 with two longitudinal grooves 220–223 the width of which is variable. The grooves 221, 223 have the full width in this illustrated embodiment, whereas the grooves 220, 222 have only half the width. The flanks 226 of the grooves which are closest to the key edges 224, 225 are inclined at an angle of approximately 15° with respect to a normal 227 to the center key plane 228. The other flanks 229, 230 directed towards the interior of the key are more steeply arranged and are inclined approximately between 5° (229) and 0° (230) to the normal to the center key plane. The here illustrated arrangement and construction of the grooves assures a particularly advantageous guidance for the key, which may be of essential importance for such complicated locks which operate on a magnetic basis. Due to the variation possibilities of the grooves, the number of variations for the key is substantially increased.

The cross-sectional configuration of the illustrated key is asymmetrical, in that at the back 225 of the key the bevels 207 meet at an angle whereas the breast 224 of the key is of flat frustoconical shape. This arrangement prevents a wrong insertion of the key into the key channel, i.e. an insertion of the key turned through 180°. This safety measure is particularly advantageous in the embodiment under discussion because a wrongly inserted key would have in place of a control ball a recess, so that the small control ball could be pushed into the core by the control pin and the core could be held by the control pin.

The holding of a wrongly coded key by control balls and control pins may be disadvantageous in some applications. This can be taken into account when lock systems are conceived, in that the control pins are always provided at the same locations in all locks of such a system. It is, however, also possible to open up the bores for the control balls in one direction of rotation, up to the plane of separation between the core and housing, as shown by the broken line 225 in FIG. 16. If the pin is caught in the bore on rotation in this one direction, then on reverse turning the pin can be lifted out of the bore again and the key can then be removed. By appropriate dimensioning of all parts it is possible to assure that on turning of the core the balls do not become jammed in their tracks.

The embodiments of the invention in which an exclusive property or privilege is claimed are as follows:

1. Closure device with a cylinder core turnable in a housing and a key insertable into a key channel, wherein the key has opposite longitudinal edges formed with recesses extending transversely to the direction of insertion and delimiting edge portions therebetween, which edge portions and recesses control blocking elements shiftable transversely to the direction of insertion of the key and which blocking elements extend in the locking position into a recess of the housing and in the unlocking position are arranged within the plane of separation between the cylinder core and the housing, the blocking elements being balls guided in bores of the cylinder core, the arrangement of at least one blocking element in the cylinder core corresponding to the arrangement of a recess on the key, the arrangement of at least one ball in the cylinder core corresponding to the arrangement of an edge portion on the key, said one ball being in a circumferential groove on the inner surface of the housing permitting a turning of the cylinder core, a key-holding multipartite pin arranged in the same plane as said one ball at the opposite longitudinal edge of the key, the division of said pin being located in the plane of separation between the cylinder core and the housing, said pin having a housing pin portion which slides under the pressure of a spring after a turning of the key through 180° over the ball held in the groove by the edge portion, or which enters into the bore of said one ball and blocks the cylinder core if a wrong key is inserted, and further including another ball guided in another bore of the cylinder core and cooperating with another edge portion and being pressed by a housing pin and spring thereof against the other edge portion, said another ball being guided in another circumferential groove of the housing and the cylinder core surface being essentially continuous at a side opposite said another bore.

2. Device according to claim 1, wherein the key has a back provided with bevels and wherein the balls which cooperate with the recesses of the key have a diameter which is approximately equal to or smaller than the spacing between the bottom of the key recess and the plane of separation between the cylinder core and the housing, and that the balls which cooperate with said bevelled edge portions have a diameter which is smaller than that of the first-mentioned balls and which is approximately equal to or smaller than the spacing between the bevels of the key and the plane of separation.

3. Device according to claim 2, wherein the bores of said cylinder core have diameters which correspond to the diameters of the balls accommodated in them.

4. Device according to claim 2, further comprising control pins cooperating with the balls of smaller diameter, each control pin having a head with a reduced diameter which corresponds to the diameter of the bore in which the balls of smaller diameter are received.

5. Device according to claim 2, wherein annular webs are arranged in the housing at the plane of separation between the cylinder core and the housing, and the first-mentioned balls are selectively arranged in regions of said webs.

6. Device according to claim 1 said key further having two opposite longitudinal sides formed with grooves which extend lengthwise of the direction of insertion and permanent magnets extending along the centerline of the key for controlling magnetic rotors arranged in the cylinder core.

7. Device according to claim 6, characterized in that said magnets are in the form of magnetic pills, the number of locations on the key provided with properly coded magnetic pills and of magnetic rotors on the lock being smaller than the maximum possible number of such locations to provide additional variation possibilities by selective arrangement of the actually used locations.

8. Device according to claim 7, wherein the non-used locations on the key carry uncoded or simulation-coded pills.

9. A key for use in a device according to claim 1, having two flat sides each provided with longitudinal grooves of variable width, each of the grooves having a flank closest to a respective key edge which is inclined relative to a normal to the central key plane at an angle of approximately 15°, other flanks of the grooves being inclined to said normal at an angle between approximately 5° and 0°.

10. Key according to claim 9, having an asymmetrical cross section to prevent reverse insertion thereof into the key channel.

11. Key according to claim 10, having a bevelled back at which the bevels meet at an angle, and a breast which is of flat frustoconical shape.

12. Device according to claim 1, wherein the key is provided at least along one of its longitudinal edges with a longitudinal groove and the key channel being provided with a corresponding longitudinal rib.

13. Device according to claim 12, wherein the key comprises a combination of at least a recess, a longitudinal groove and a magnetically coded magnetic pill, which cooperate to provide various lock variation possibilites.

14. Device according to claim 1 wherein the key has four permanent magnets, one of which is located in the region of the tip of the key.

15. Device according to claim 1, wherein one of the edge portions is located at the tip of the key and constructed as an abutment for a coupling element which is shiftable in the axial direction in a slot formed on the periphery of the cylinder core and engageable with a coupling plate which is connected with a blocking ring.

16. Device according to claim 1, wherein the key channel is centrally arranged in the cylinder core and wherein said bores of the cylinder core are located in the plane of the key channel.

17. Device according to claim 1, wherein the longitudinal edges of the key are selectively provided with additional recesses, and the cylinder core is provided with corresponding balls shiftable in a direction towards the recesses of the housing, and that additional bores are provided in the cylinder core in which balls are engageable by portions of the key edges, and further comprising a third housing pin which is spring-biased and can enter into one of said additional bores in the cylinder core so as to block the core against further rotation.

18. Device according to claim 1, wherein the longitudinal edges of the key are provided with recesses which are inclined to the center plane of the key.

19. Device according to claim 1, wherein the key holding pin has a core pin portion in the form of two superjacent balls.

* * * * *